US011417972B2

(12) United States Patent
Chang et al.

(10) Patent No.: US 11,417,972 B2
(45) Date of Patent: Aug. 16, 2022

(54) FIXING STRUCTURE OF CONNECTOR

(71) Applicant: JESS-LINK PRODUCTS CO., LTD., New Taipei (TW)

(72) Inventors: Hsu-Feng Chang, New Taipei (TW); Ya-Fen Kao, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 17/373,778

(22) Filed: Jul. 13, 2021

(65) Prior Publication Data

US 2022/0181802 A1 Jun. 9, 2022

(30) Foreign Application Priority Data

Dec. 7, 2020 (TW) ..... 109143058

(51) Int. Cl.

| | |
|---|---|
| ***H01R 4/66*** | (2006.01) |
| ***H01R 9/24*** | (2006.01) |
| ***H01R 13/627*** | (2006.01) |
| ***H01R 9/03*** | (2006.01) |

(52) U.S. Cl.

CPC ..... *H01R 9/2491* (2013.01); *H01R 9/031* (2013.01); *H01R 13/6273* (2013.01)

(58) Field of Classification Search

CPC ..... H01R 25/142; H01R 13/518; H01R 23/7005; H01R 27/7068

See application file for complete search history.

(56) References Cited

U.S. PATENT DOCUMENTS

| | | | | |
|---|---|---|---|---|
| 9,780,497 | B1 * | 10/2017 | Jeon | H01R 13/659 |
| 10,318,134 | B2 * | 6/2019 | Ording | G06F 3/0482 |
| 10,566,722 | B2 * | 2/2020 | Lee | H01R 12/62 |
| 2013/0139091 | A1 * | 5/2013 | Raciborski | H04L 65/80 709/217 |
| 2019/0109404 | A1 * | 4/2019 | Willems | H01R 13/514 |
| 2019/0252819 | A1 * | 8/2019 | Jeon-Haurand | G09F 9/33 |

* cited by examiner

*Primary Examiner* — Phuong Chi Thi Nguyen

(74) *Attorney, Agent, or Firm* — Chun-Ming Shih; HDLS IPR Services

(57) ABSTRACT

A fixing structure of a connector is disclosed. The connector includes an insert portion and multiple wires connected to the insert portion. The fixing structure includes a wire binding block, a lower shell and an upper shell disposed with multiple first engaging structures. The lower shell is disposed with multiple second engaging structures separately corresponding to the first engaging structures and connected with the upper shell to form a chamber for receiving the connector and form a wiring hole for being passed by the wires. The wires are extended from the insert portion toward the wiring hole to form a bend section and a curve section in the chamber. The wire binding block is fixed on the curve section of the wires and clamped by the upper shell and the lower shell through engagement of the first engaging structures and the second engaging structures.

10 Claims, 5 Drawing Sheets

FIXING STRUCTURE OF CONNECTOR

BACKGROUND

Technical Field

The disclosure relates to a fixing structure, particularly to a fixing structure of a connector.

Related Art

The related-art connectors have a horizontal type and a vertical type for satisfying various spaces and arrangements. The direction of terminals and the wire outgoing direction of wires of the horizontal-type connectors are in the same horizontal direction, and the direction of terminals and the wire outgoing direction of wires of the vertical-type connectors are perpendicular to each other to accomplish extensiveness of being installed in different circumstances.

However, the vertical-type connectors need to bend the wires 90 degrees, so the lengths of the wires after being bent are inconsistent due to different bending degrees. Thus, in order to ensure that the lengths of the wires projecting from the case are the same, the wires having different lengths after being bent are pressed into the case. That causes that the wires in the case form a curve section. The curve section pushes the case outward because of irregular distortion, and makes the case difficult to be engaged and fixed or makes the wires inside the case be pulled out when the wires are unintentionally pulled. This is an issue to be resolved.

In view of this, the inventors have devoted themselves to the above-mentioned related art, researched intensively and cooperated with the application of science to try to solve the above-mentioned problems. Finally, the disclosure which is reasonable and effective to overcome the above drawbacks is provided.

SUMMARY

An object of the disclosure is to effectively fix the flexed wires to avoid the case being opened when the wires are pulled.

To accomplish the above object, the disclosure provides a fixing structure of a connector. The connector includes an insert portion and multiple wires connected to the insert portion. The fixing structure includes a wire binding block, an upper shell and a lower shell. The upper shell is disposed with multiple first engaging structures. The lower shell is disposed with multiple second engaging structures separately corresponding to the first engaging structures and connected with the upper shell to form a chamber receiving the connector and a wiring hole being passed by the wires. The wires are extended from the insert portion toward the wiring hole to form a bend section and a curve section in the chamber. The wire binding block is fixed on the curve section of the wires and clamped by the upper shell and the lower shell through engagement of the first engaging structures and the second engaging structures.

The disclosure further has following functions. By the engaging blocks and the engaging holes, the connector and the upper shell may be preliminarily fixed. By each hook and each positioning sheet engaging with each clamping trough and each positioning trough, the upper shell and the lower shell may be fixed. By the stopping blocks formed on two sides of the wire binding block, the wire binding block and the wires may be prevented from being pulled out of the case when the wires are pulled outward.

DETAILED DESCRIPTION

Figure 1:
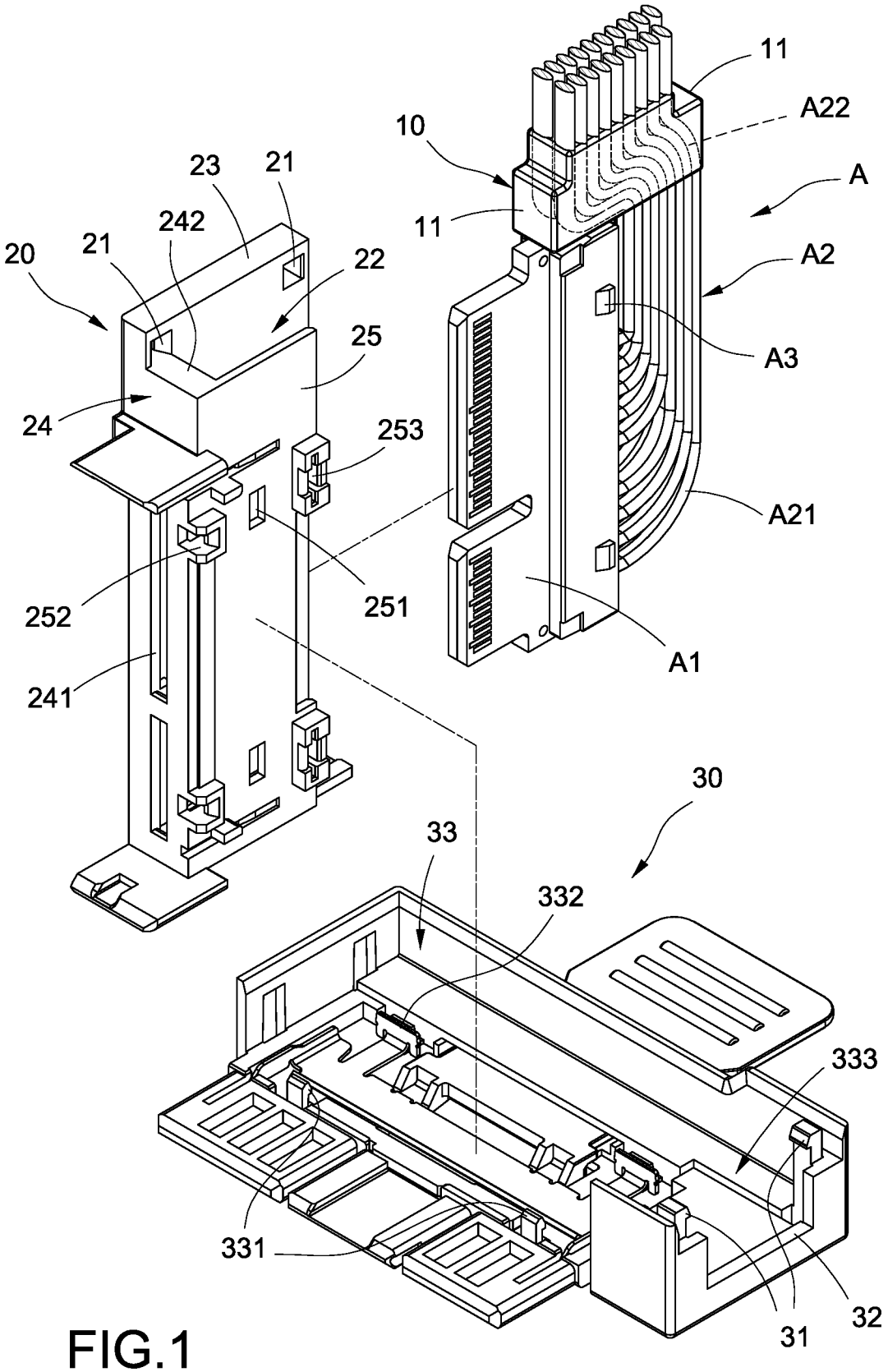
FIG. 1 is an exploded view of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

The disclosure provides a fixing structure of a connector. Please refer to FIGS. 1-3. The connector A includes an insert portion A1 and multiple wires A2 connected to the insert portion A1. The fixing structure includes a wire binding block 10, an upper shell 20 and a lower shell 30.

The upper shell 20 is disposed with multiple first engaging structures 21. The lower shell 30 is disposed with multiple second engaging structures 31 separately corresponding to the first engaging structures 21. The lower shell 30 is connected with the upper shell 20 to form a chamber 22 for receiving the connector A and form a wiring hole 32 for being passed by the wires A2. The wires A2 are extended from the insert portion A1 toward the wiring hole 32 to form a bend section A21 and a curve section A22 in the chamber 22. The wire binding block 10 is fixed on the curve section A22 of the wires A2 and clamped by the upper shell 20 and the lower shell 30 through engagement of the first engaging structures 21 and the second engaging structures 31.

In detail, the upper shell 20 is integrally formed (or formed in one piece) by injection molding, and has a top plate 23 and a sidewall 24 formed on a side of the top plate 23. The sidewall 24 is formed with an opening 241 for being passed by the insert portion A1. When assembling, the connector A is inserted to the upper shell 20 for preliminary fixing to facilitate the connection with the lower shell 30. A side of the sidewall 24 away from the top plate 23 is extended to form a bottom plate 25. The top plate 23, the sidewall 24 and the bottom plate 25 collectively constitute the chamber 22. The bottom plate 25 is formed with multiple engaging holes 251. The connector A is convexly provided with multiple engaging blocks A3 corresponding to and engaging with the engaging holes 251 respectively so as to fix the connector A and the upper shell 20.

Figure 2:
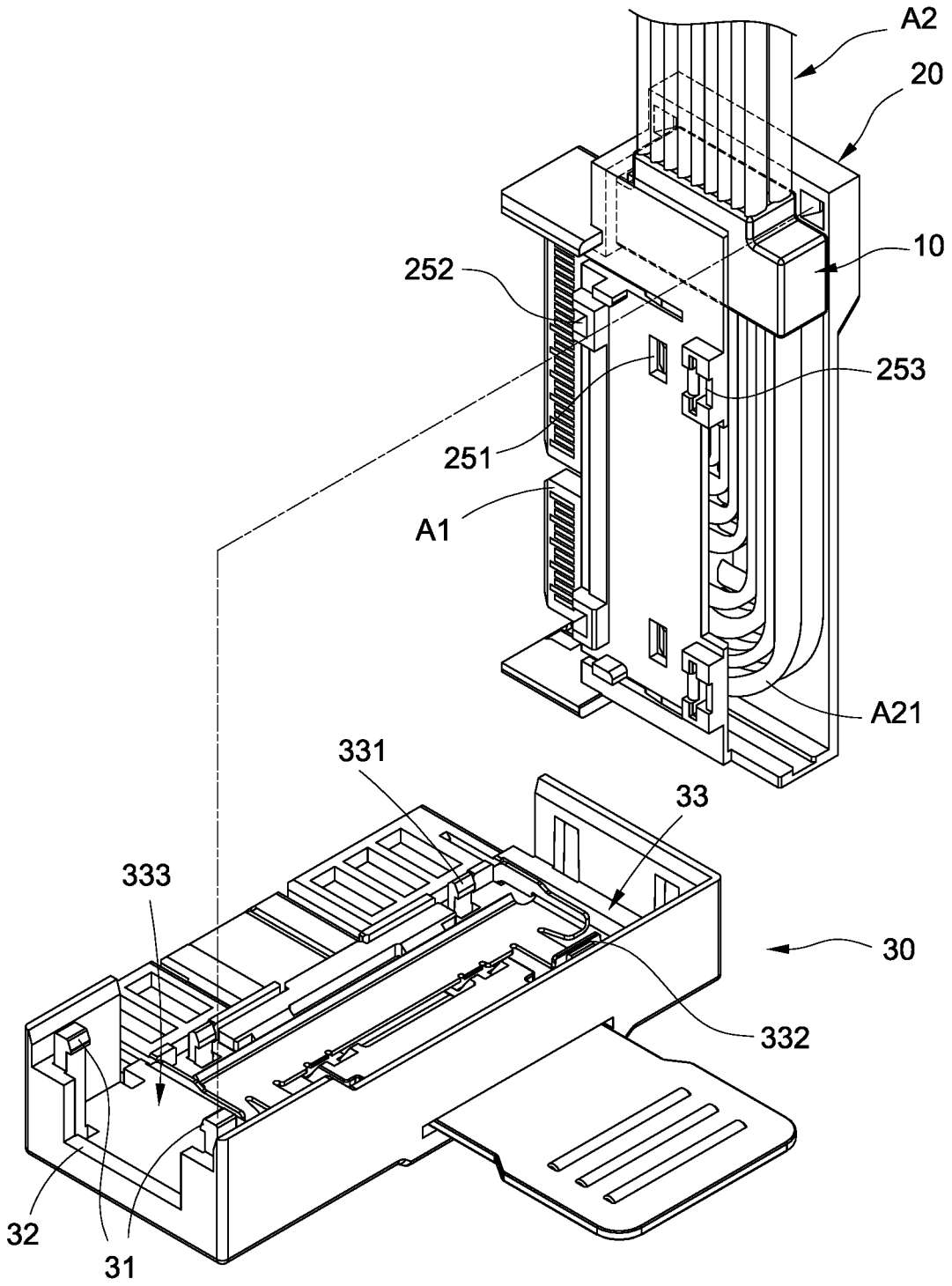
FIG. 2 is another exploded view of the disclosure.
Figure 4:
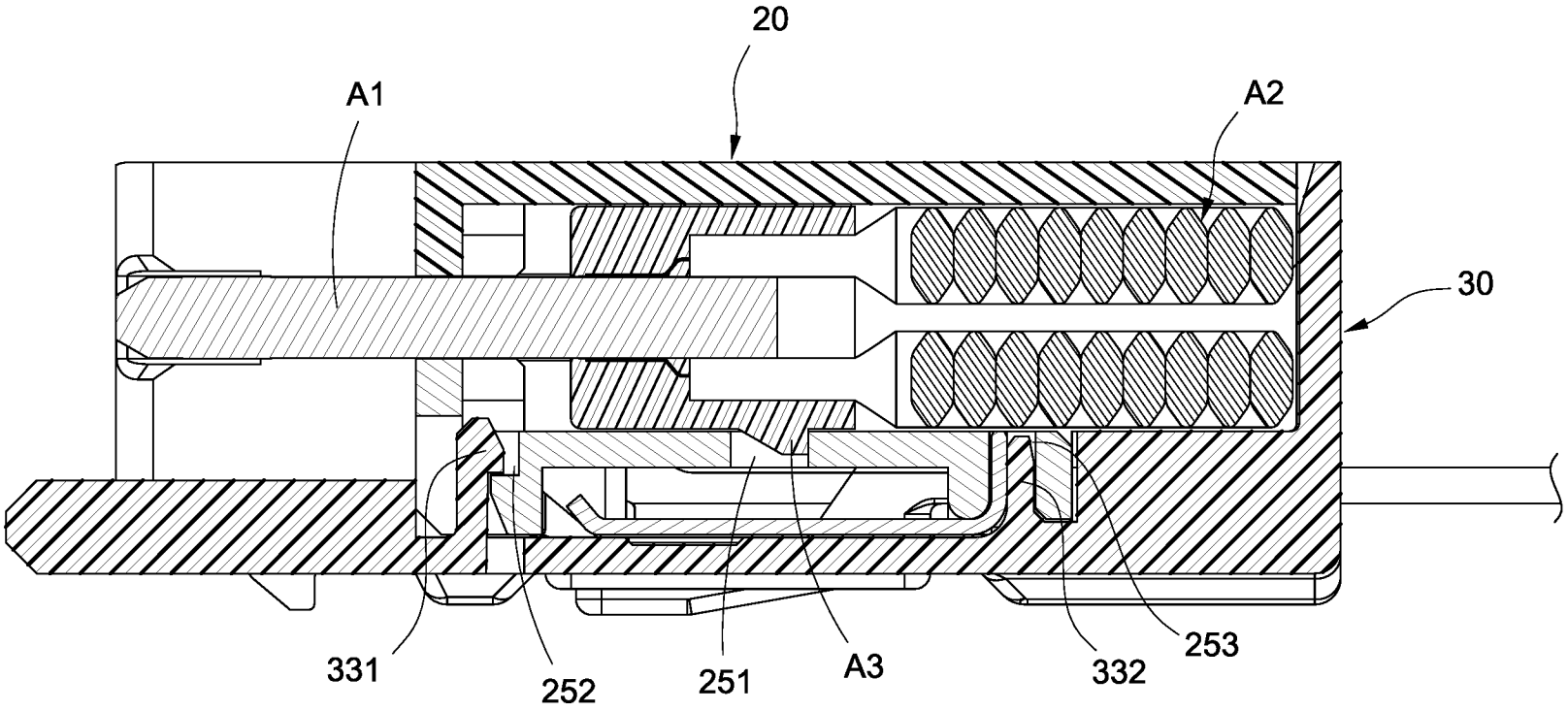
FIG. 4 is a cross-sectional view along line 4-4 in FIG. 3.

Please refer to FIGS. 1 and 4. The lower shell 30 is integrally formed (or formed in one piece) by injection molding, and has a room 33 for receiving the upper shell 20. The inside of the room 33 is formed with multiple hooks 331 and multiple positioning sheets 332. The bottom plate 25 is formed with multiple clamping troughs 252 separately engaged with the hooks 331 and multiple positioning troughs 253 separately engaged with the positioning sheets 332, so that the upper shell 20 and the lower shell 30 may be connected and fixed. Please refer to FIGS. 1 and 5. The room 33 has a wire binding area 333 for receiving the wire binding block 10. Each first engaging structure 21 and each second engaging structure 31 are formed between the wire binding area 333 and the wiring hole 32. Each first engaging structure 21 is an internal engaging recess and each second engaging structure 31 is an internal engaging arm correspondingly engaged with each internal engaging recess, so that the upper shell 20 and the lower shell 30 may be tightly engaged to enhance the engaging strength at the location of the wire binding block 10 near the wiring hole 32.

Figure 5:
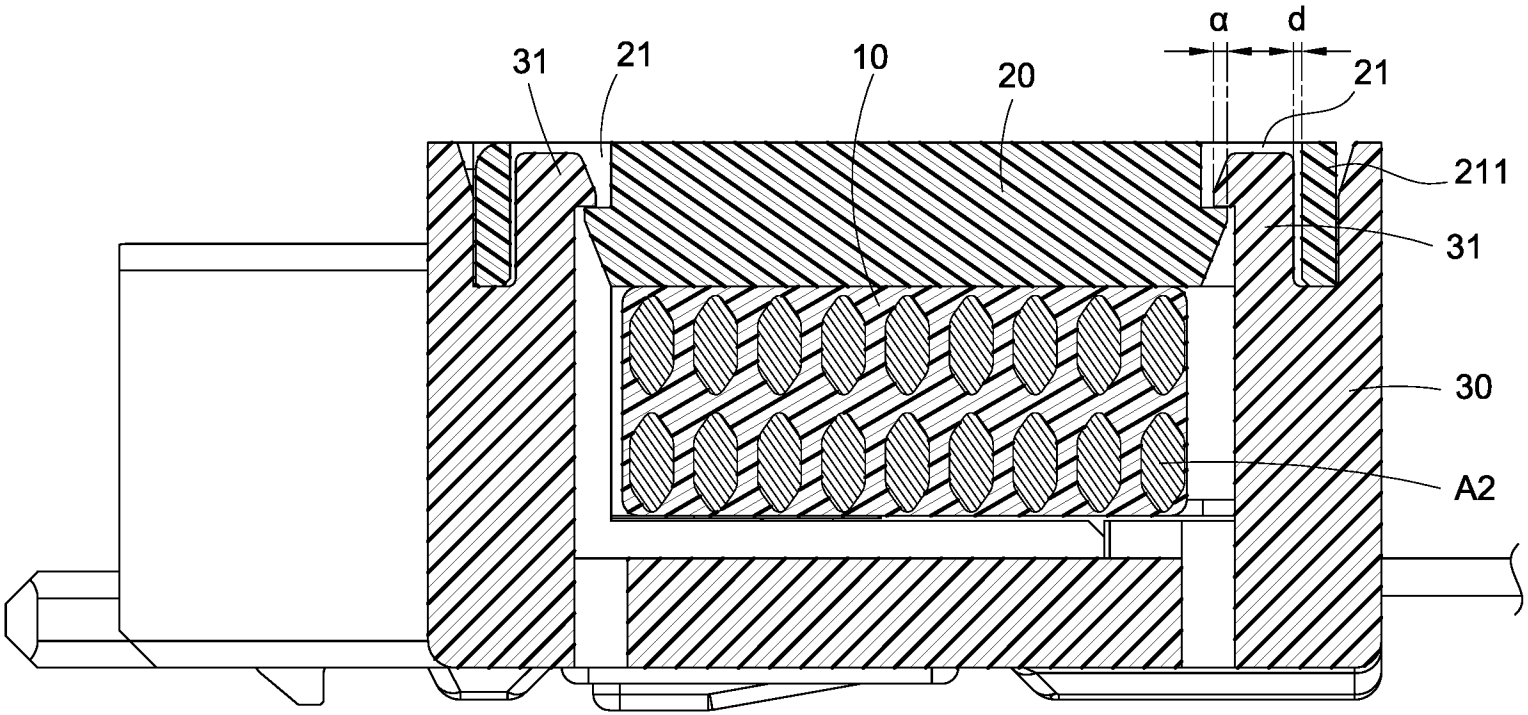
FIG. 5 is a cross-sectional view along line 5-5 in FIG. 3.

Please further refer to FIG. 5. An offset required for the internal engaging arm separating from the internal engaging recess is an overlapping length a of overlapping (stacking) the internal engaging arm and the internal engaging recess. Each internal engaging recess is formed with a stopping wall 211 to form a distance d between the internal engaging arm and the stopping wall 211. The distance d is less than the overlapping length a, so that the internal engaging arm is blocked by the stopping wall 211 and hard to be separated when the upper shell 20 and the lower shell 30 are pulled to separate the internal engaging arm from the internal engaging recess. An external tool is required to push the internal engaging arm rearward to separate the upper shell 20 and the lower shell 30. Such an internal engaging structure may keep the internal engaging arm and the internal engaging recess engaged to avoid unexpected separation of the internal engaging arm and the internal engaging recess and separation of the upper shell 20 and the lower shell 30.

Figure 3:
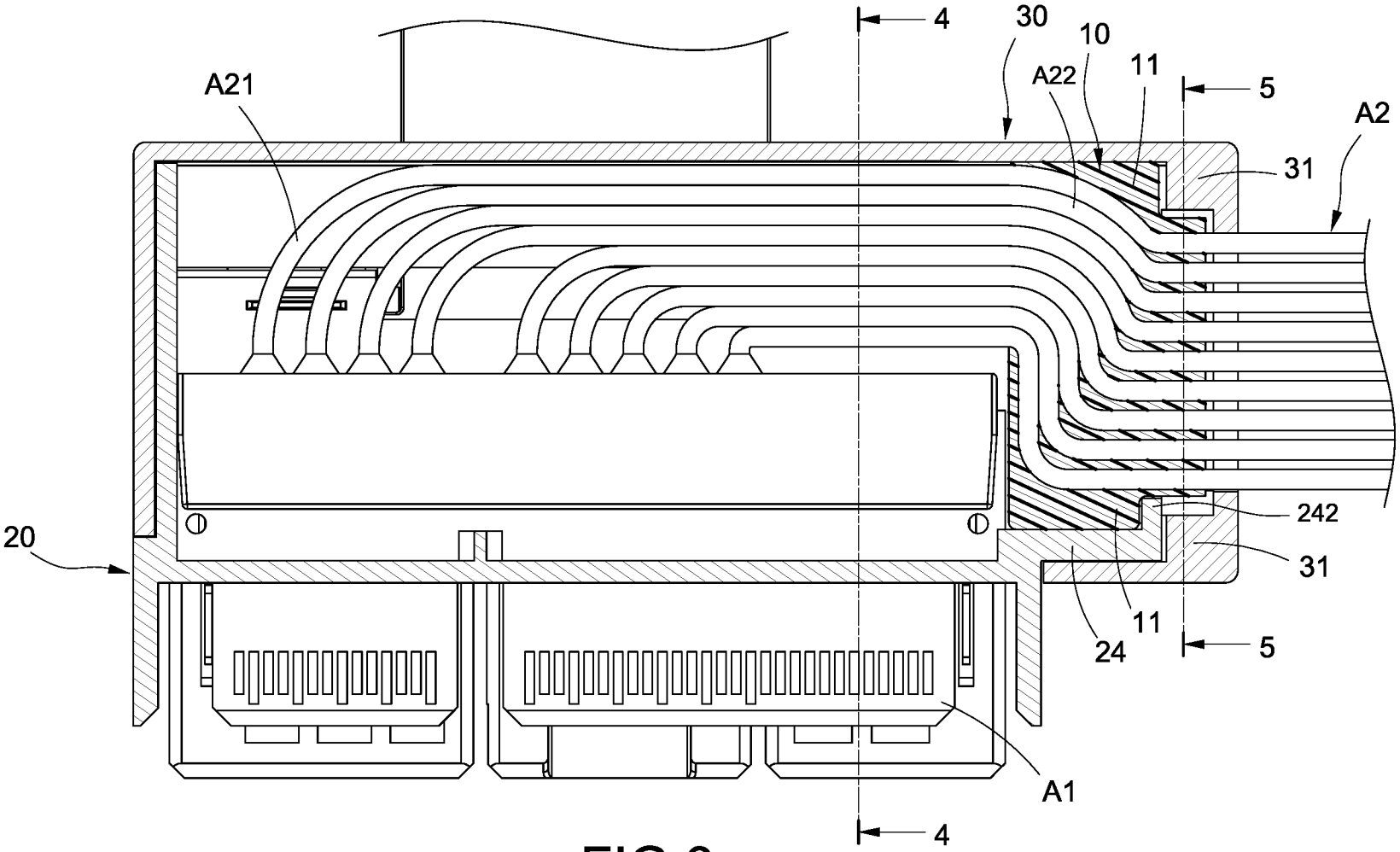
FIG. 3 is a cross-sectional view of the disclosure.

Please refer to FIG. 3. The wire binding block 10 is integrally formed (or formed in one piece) by injection molding and is formed with a stopping block 11 protruding from two sides thereof respectively. The sidewall 24 is formed with a blocking sheet 242 near the internal engaging recess for abutting against the internal engaging arm. Each stopping block 11 is arranged corresponding to the blocking sheet 242 and the internal engaging arm so as to prevent the wire binding block 10 and the wires A2 from being pulled out of the upper shell 20 and the lower shell 30 when the wires A2 are pulled outward.

Please refer back to FIG. 1. The assembling process of the fixing structure of the disclosure and the connector A is described below. The connector A is placed in the upper shell 20 for preliminary fixture to make the insert portion A1 pass through of the opening 241 and each engaging block A3 being engaged with each engaging hole 251, both the upper shell 20 and the connector A, which are assembled, are placed in the room 33 of the lower shell 30 to make each hook 331 and each positioning sheet 332 engage with each clamping trough 252 and each positioning trough 253, and each internal engaging recess is being engaged with each internal engaging arm. Thus, the assembling of the fixing structure and the connector A is finished.

While this disclosure has been described by means of specific embodiments, numerous modifications and variations could be made thereto by those skilled in the art without departing from the scope and spirit of this disclosure set forth in the claims.

What is claimed is:

1. A fixing structure of a connector, the connector comprising an insert portion and multiple wires connected to the insert portion, the fixing structure comprising:

a wire binding block;

an upper shell, comprising multiple first engaging structures; and a lower shell, comprising multiple second engaging structures corresponding to the first engaging structures respectively, and connected with the upper shell to configure a chamber receiving the connector and configure a wiring hole being passed by the wires;

wherein the wires are extended from the insert portion toward the wiring hole to configure a bend section and a curve section in the chamber, and the wire binding block is fixed on the curve section of the wires and clamped by the upper shell and the lower shell through engagement of the first engaging structures and the second engaging structures.

2. The fixing structure of claim 1, wherein each first engaging structure comprises an internal engaging recess, and each second engaging structure comprises an internal engaging arm correspondingly engaged with each internal engaging recess.

3. The fixing structure of claim 2, wherein the internal engaging arm and the internal engaging recess are stacked with an overlapping length, a stopping wall is disposed on each internal engaging recess to configure a distance between the internal engaging arm and the stopping wall.

4. The fixing structure of claim 3, wherein the distance is less than the overlapping length.

5. The fixing structure of claim 1, wherein the upper shell comprises a top plate and a sidewall disposed on a side of the top plate, and the sidewall comprises an opening being passed by the insert portion.

6. The fixing structure of claim 5, wherein a bottom plate is extended from the sidewall, and the chamber is configured by the top plate, the sidewall and the bottom plate collectively.

7. The fixing structure of claim 6, wherein the bottom plate comprises multiple engaging holes, and the connector comprises multiple engaging blocks disposed convexly thereon corresponding to and engaged with the engaging holes respectively.

8. The fixing structure of claim 6, wherein the lower shell comprises a room receiving the upper shell, multiple hooks and multiple positioning sheets are disposed in the room, the bottom plate comprises multiple clamping troughs and multiple positioning troughs, each clamping trough is engaged with each hook, and each positioning trough is engaged with each positioning sheet.

9. The fixing structure of claim 8, wherein the room comprises a wire binding area receiving the wire binding block, and each first engaging structure and each second engaging structure are disposed between the wire binding area and the wiring hole.

10. The fixing structure of claim 9, wherein a stopping block is disposed protrusively on two sides of the wire binding block respectively, a blocking sheet is disposed on the sidewall adjacent to the first engaging structure, and each stopping block is arranged corresponding to the blocking sheet and each second engaging structure.

* * * * *